US007600942B2

(12) United States Patent
Yodock, III et al.

(10) Patent No.: US 7,600,942 B2
(45) Date of Patent: Oct. 13, 2009

(54) BARRIER DEVICE WITH ADJUSTABLE EXTERNAL REINFORCEMENT STRUCTURE

(76) Inventors: Leo J. Yodock, III, 1775 Fifth Street Hollow Rd., Bloomsburg, PA (US) 17815; Leo J. Yodock, Jr., 44 Duke of Gloucester St., Bloomsburg, PA (US) 17815; Guy C. Yodock, 5871 8 Point La., Lakeland, FL (US) 33811

( * ) Notice: Subject to any disclaimer, the term of this patent is extended or adjusted under 35 U.S.C. 154(b) by 0 days.

(21) Appl. No.: 12/245,262

(22) Filed: Oct. 3, 2008

(65) Prior Publication Data

US 2009/0041540 A1 Feb. 12, 2009

Related U.S. Application Data

(60) Continuation-in-part of application No. 11/764,853, filed on Jun. 19, 2007, which is a division of application No. 11/082,630, filed on Mar. 17, 2005, now Pat. No. 7,351,002, which is a continuation-in-part of application No. 10/669,998, filed on Sep. 24, 2003, now abandoned, which is a division of application No. 10/033,974, filed on Dec. 19, 2001, now Pat. No. 6,666,616.

(60) Provisional application No. 60/977,830, filed on Oct. 5, 2007.

(51) Int. Cl.
*E01F 13/00* (2006.01)

(52) U.S. Cl. ..... 404/6

(58) Field of Classification Search ..... 404/6; 256/13.1

See application file for complete search history.

(56) References Cited

U.S. PATENT DOCUMENTS

| | | | |
|---|---|---|---|
| 3,877,681 | A | 4/1975 | Humphrey |
| 4,059,362 | A | 11/1977 | Smith |
| 4,391,077 | A | 7/1983 | Giess |
| 4,435,106 | A | 3/1984 | Forster et al. |
| 4,452,431 | A | 6/1984 | Stephens et al. |
| 4,496,264 | A | 1/1985 | Casey |
| 4,553,875 | A | 11/1985 | Casey |
| 4,681,302 | A | 7/1987 | Thompson |
| 4,722,513 | A | 2/1988 | Gaillard et al. |
| 4,773,629 | A | 9/1988 | Yodock |
| 4,946,138 | A | 8/1990 | Gaillard et al. |
| 4,946,306 | A | 8/1990 | Yodock |
| 5,030,029 | A | 7/1991 | Johnsen |
| 5,123,773 | A | 6/1992 | Yodock |
| 5,387,049 | A | 2/1995 | Duckett |
| 5,425,594 | A | 6/1995 | Krage et al. |

(Continued)

*Primary Examiner*—Gary S Hartmann
(74) *Attorney, Agent, or Firm*—GrayRobinson, P.A.

(57) ABSTRACT

A barrier device comprises a top wall, a bottom wall, opposed end walls and opposed side walls interconnected to form a hollow interior in which a pair of spaced openings are formed which extend between the side walls. An external reinforcement structure is provided to enhance the structural integrity of the barrier device, including first and second beams each located along one of the side walls which are connected to one another by adjustable mounting structure extending through the openings. The beams of one barrier device, in turn, are connected end-to-end with the beams of an adjacent barrier device to form an essentially continuous, interconnected wall of barriers which resist disengagement from one another and exhibit improved resistance to being broken apart upon impact by a vehicle.

14 Claims, 7 Drawing Sheets

U.S. PATENT DOCUMENTS

| | | | | |
|---|---|---|---|---|
| 5,498,101 | A | 3/1996 | Braverman | |
| 5,531,540 | A | 7/1996 | Wasserstrom et al. | |
| 5,605,413 | A | 2/1997 | Brown | |
| 5,882,140 | A | 3/1999 | Yodock, Jr. et al. | |
| 6,164,865 | A | 12/2000 | McCallum | |
| 6,179,516 | B1 | 1/2001 | Ivey et al. | |
| 6,428,237 | B1 | 8/2002 | Duckett | |
| 6,666,616 | B2 | 12/2003 | Yodock, III et al. | |
| 6,669,402 | B1 | 12/2003 | Davis et al. | |
| 6,843,614 | B2 | 1/2005 | Yodock, Jr. et al. | |
| 6,848,857 | B1 | 2/2005 | McColl et al. | |
| 6,863,468 | B2 | 3/2005 | Davis et al. | |
| 6,951,434 | B2 | 10/2005 | Yodock, Jr. et al. | |
| 7,351,002 | B2 * | 4/2008 | Yodock et al. | 404/6 |
| 2004/0057792 | A1 | 3/2004 | Yodock, III et al. | |
| 2007/0243015 | A1 * | 10/2007 | Yodock et al. | 404/6 |

* cited by examiner

BARRIER DEVICE WITH ADJUSTABLE EXTERNAL REINFORCEMENT STRUCTURE

RELATED APPLICATION

This application claims the benefit of U.S. Provisional Application Ser. No. 60/977,830 filed Oct. 5, 2007 under 35 U.S.C. § 119(e) for all commonly disclosed subject matter, which is expressly incorporated herein by reference in its entirety to form part of the present disclosure, and is a continuation-in-part of U.S. patent application Ser. No. 11/764,853 filed Jun. 19, 2007, which is a divisional of U.S. patent application Ser. No. 11/082,630 filed Mar. 17, 2005, now U.S. Pat. No. 7,351,002 issued Apr. 1, 2008, which is a continuation-in-part of U.S. patent application Ser. No. 10/669,998, filed Sep. 24, 2003, which is a divisional of U.S. patent application Ser. No. 10/033,974, filed Dec. 19, 2001, now U.S. Pat. No. 6,666,616, issued Dec. 23, 2003.

FIELD OF THE INVENTION

This invention relates to barrier devices for vehicular and vessel traffic control, soil erosion containment, impact attenuation and the like which can be interconnected with one another to define a continuous barrier wall structure and/or connected in various combinations to form energy-absorbing cells, and, more particularly, to barrier devices formed of a light weight plastic having side walls which receive and mount an adjustable external reinforcement structure in the form of a pair of beams each extending along the length of one of the side walls.

BACKGROUND OF THE INVENTION

A variety of different devices have been developed for absorbing the kinetic energy of impact of colliding automobiles, and for the containment of forces exerted by soil or water. Highway barrier devices, for example, are intended to provide a continuous wall or barrier along the center line of a highway when laid end-to-end to absorb grazing blows from moving vehicles. One commonly used highway barrier is formed of pre-cast reinforced concrete, and is known as the "New Jersey" style barrier. Highway barriers of this type have a relatively wide base including side walls which extend vertically upwardly from the pavement a short distance, then angle inwardly and upwardly to a vertically extending top portion connected to the top wall of the barrier. This design is intended to contact and redirect the wheels of a vehicle in a direction toward the lane of traffic in which the vehicle was originally traveling, instead of the lane of opposing traffic. See U.S. Pat. No. 4,059,362.

One problem with highway barriers of the type described above is the high weight of reinforced concrete. A barrier having a typical length of twelve feet weighs about 2,800-3,200 pounds and requires special equipment to load, unload and handle on site. It has been estimated that for some road repairs up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicle.

In an effort to reduce weight, facilitate handling and shipment, and provide improved absorption of impact forces, highway barriers have been designed which are formed of a hollow plastic container filled with water, sand or other ballast material such as disclosed in U.S. Pat. Nos. 4,681,302; 4,773,629; 4,846,306, 5,123,773 and 5,882,140. For example, the '302 patent discloses a barrier comprising a container having a top wall, a bottom wall, opposed side walls and opposed end walls interconnected to form a hollow interior which is filled with water, and having fittings for coupling one barrier to another to form a continuous wall. The container structure is formed of a resilient material which is deformable upon impact and capable of resuming its original shape after being struck. Traction spoiler channels are provided to reduce the area of potential impact and thus the tendency of the vehicle to climb the walls of the barrier and vault over it into the opposing lane of traffic.

The '629, '306, '773 and '140 patents noted above represent further advances in deformable highway barrier designs. The first two patents disclose barriers which comprise a longitudinally extending container made of semi-rigid plastic which is self-supporting, and has a predetermined shape which is maintained when filled with water, sand or other ballast material. Such devices are connected end-to-end by a key insertable within grooves formed in the end walls of adjacent barriers. Interconnected fill openings are provided which permit adjacent barriers to be filled with water or the like when laid end-to-end.

The '773 and '140 patents disclose additional improvements in barrier devices including side walls formed with higher curb reveals, a horizontally extending step and vertical indentations in order to assist in maintaining the structural integrity of the container, and to create internal baffles for dampening movement of water or other fluid within the container interior. Interlocking male and female coupling elements are formed on opposite end walls of the barrier to facilitate end-to-end connection thereof. Additionally, such barriers are provided with channels or openings to permit the insertion of the tines of a fork lift truck therein for easy handling of the barriers.

Despite the improvements in highway barrier designs noted above, some deficiencies nevertheless remain. One concern has been with the ability of a wall of barriers, e.g. individual barriers connected end-to-end, to withstand a direct impact by a speeding vehicle. It has been found that plastic barriers tend to separate from one another at their connections, and in some instances break apart in response to a vehicle impact. Although concrete barriers of the type described above also can break apart during a crash, they are more resistant to that than plastic barriers and there is a need for plastic barriers to demonstrate impact resistance capabilities which more closely approximates those of concrete barriers.

SUMMARY OF THE INVENTION

This invention is directed to a barrier device comprising a top wall, a bottom wall, opposed end walls and opposed side walls interconnected to form a hollow interior in which a pair of spaced fork lift openings are formed which extend between the side walls. An external reinforcement structure is provided to enhance the structural integrity of the barrier device, including first and second beams each located along one of the side walls which are connected to one another by adjustable mounting structure extending through the openings. The beams of one barrier device, in turn, are connected end-to-end with the beams of an adjacent barrier device to form an essentially continuous, interconnected wall of barriers which resist disengagement from one another and exhibit improved resistance to being broken apart upon impact by a vehicle.

In one presently preferred embodiment of this invention, the external reinforcement structure comprises a first box beam and a second box beam, each generally square in cross section and formed of metal, rubber, composite material or the like. The two box beams are connected to one another by a pair of mounting devices each including a side plate welded to one of the box beams, a base plate extending generally perpendicular to the side plate, and a locking plate oriented generally perpendicular to both the side plate and base plate. The side plate, base plate and locking plate of each mounting device are welded together to form a one-piece, rigid structure. The locking plate connected to one of the beams is formed with a first bore, and the locking plate connected to the other beam is formed with spaced second and third bores.

In order to mount the beams along the side walls of a barrier device, the base plate and locking plate of the mounting device connected to each beam are inserted within the fork lift openings such that the first bore of one locking plate aligns with one of the second and third bores of the other locking plate. A fastener such as a bolt may be inserted through the aligning bores to connect the locking plates together, and thus secure the beams along respective side walls of the barrier device. Depending upon which of the second and third bores is positioned in alignment with the first bore, the lateral spacing between the beams may be varied to accommodate barrier devices of different width.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
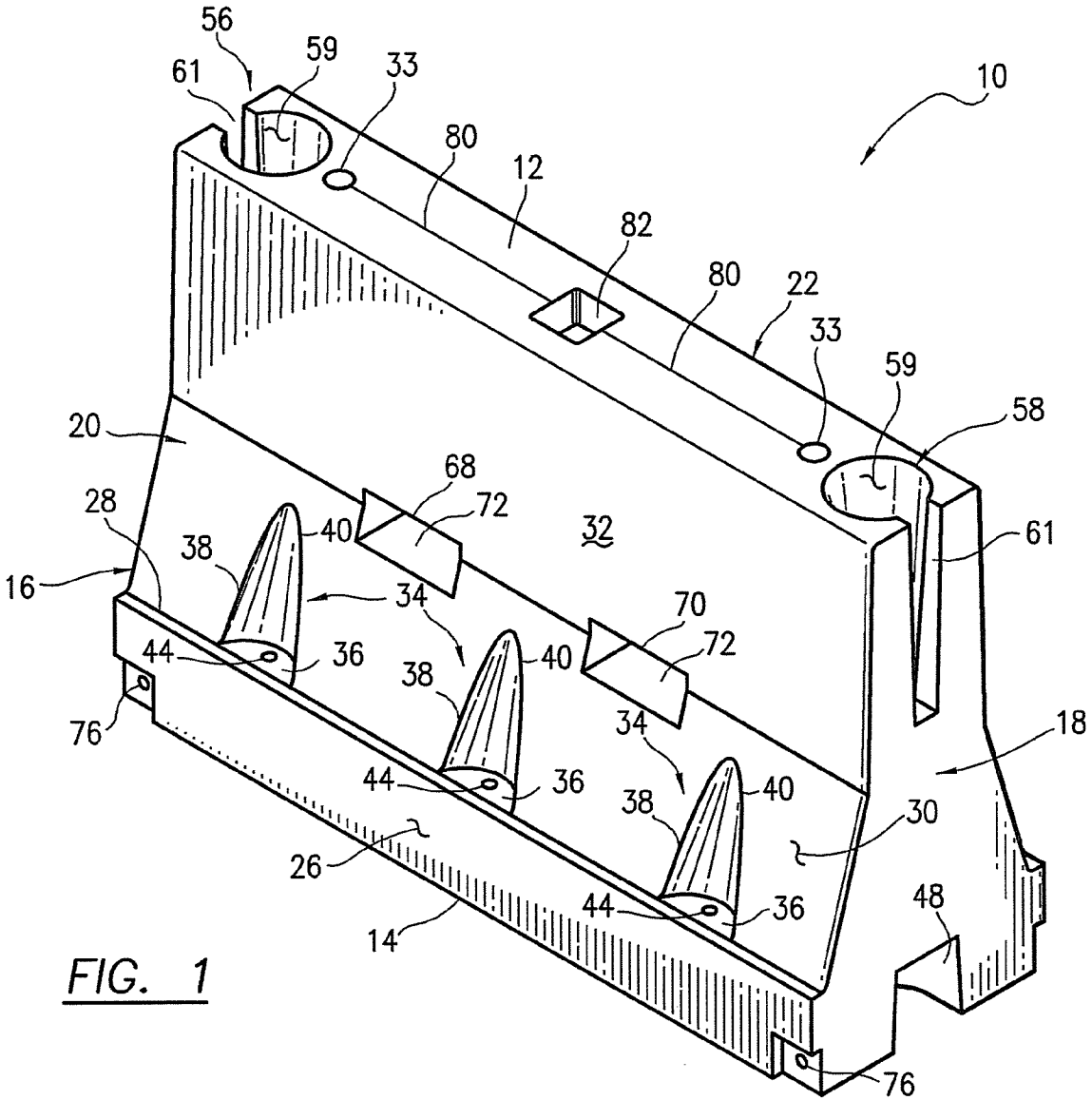
FIG. 1 is a perspective view of a barrier device of this invention.

Referring initially to FIGS. 1-4, the barrier device 10 of this invention comprises a top wall 12, a bottom wall 14; opposed end walls 16, 18, and, opposed side walls 20, 22 which are interconnected to collectively define a hollow interior 24. In the presently preferred embodiment, each of the walls 12-22 are formed of a semi-rigid plastic material chosen from the group consisting of low density polyethylene, high density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact with them. Additionally, materials of this type are unaffected by weather and have excellent basic resistance to weathering, leaching and biodegradation. Additives such as ultraviolet inhibitors can be added thereto, making such materials further resistant to the effects of weather. They also retain their mechanical and chemical properties at low ambient temperatures.

When using the barrier device 10 of this invention as a highway barrier, the hollow interior 24 is preferably filled with a "ballast" material such as water or other liquid, or a flowable solid material such as sand, gravel and the like. For this purpose, the walls 12-22 of barrier device 10 have a thickness in the range of about one-eighth inch to one inch so as to perform satisfactorily in service. The barrier device 10 is preferably in the range of about six to eight feet in length, and, at the wall thickness noted above, has a weight when empty of about 80 to 140 lbs. When filled with a liquid such as water, the overall weight of the barrier is in the range of about 1400 to 2200 lbs. Flowable solid material such as sand and the like increase the weight of barrier 10 further.

Both side walls 20, 22 are identical in configuration, and only side wall 20 is described in detail herein it being understood that the side wall 22 is formed with the identical structure and functions in the same manner. The side wall 20 includes a substantially vertical curb reveal 26 which extends from the bottom wall 14 to a horizontally extending ledge or step 28 best shown in FIG. 1. Preferably, the curb reveal 26 has a vertical height of about nine inches, measured from the bottom wall 14 upwardly, which is at least two inches greater than the curb reveals of other highway barrier devices, such as disclosed, for example, in U.S. Pat. No. 5,123,773. The horizontal extent of the step 28 is preferably on the order of about 1½ inches measured in the direction from the outer edge of curb reveal 26 toward the hollow interior 24 of barrier device 10.

Extending upwardly at an acute angle from the step 28 is an intermediate section 30 which terminates at a vertical upper section 32. The upper section 32, in turn, connects the intermediate section 30 to the top wall 12 of barrier 10 which is formed with a pair of fill holes 33 preferably having a diameter in the range of about 3-4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. As best seen in FIG. 1, the base 36 of each stabilizer 34 is coplanar with the step 28 and is supported by an internally located support 42 shown in phantom lines in FIG. 3. The sides 38, 40 of each stabilizer 34 taper inwardly, toward one another, from the base 36 to a point substantially coincident with the uppermost edge of intermediate section 30 where the upper section 32 of side wall 20 begins. In the presently preferred embodiment, a throughbore 44 extends from the base 36 of one or more of the stabilizers 34, through the internal support 42 and out the bottom wall 14 of barrier 10. One or more of these throughbores 44 receive an anchoring device such as a stake 46, shown in phantom in FIG. 3, which can be driven into the ground or other surface upon which the barrier device 10 rests to secure it thereon.

Figure 4:
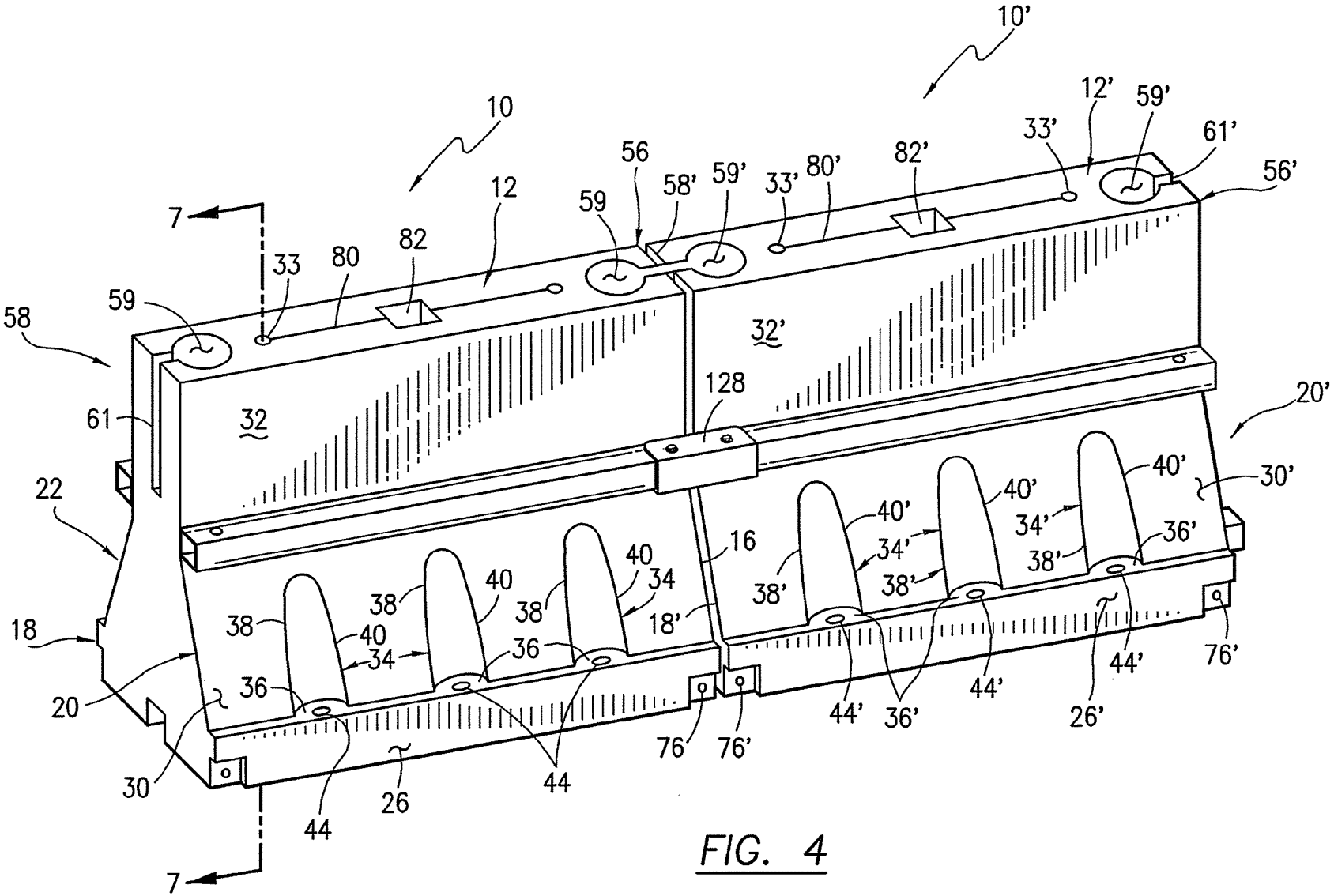
FIG. 4 is a perspective view of two barriers connected end-to-end with the adjustable external reinforcement structure of this invention shown in place.

With reference to FIG. 4, structure is provided to resist disengagement of adjacent barrier devices 10 and 10' when they are arranged end-to-end to form an essentially continuous barrier wall, and to resist the break up or disintegration of individual barrier devices 10 and 10' in response to impact by a vehicle. The two barrier devices 10 and 10' depicted in FIG. 4 are identical in structure and function, and the same reference numbers are therefore used to identify like structure, with the addition of a "'" to the numbers associated with barrier 10' on the right-hand side of FIG. 4.

Each end wall 16 of barriers 10 is formed with an internally extending recess 48 near the bottom wall 14, which receives an outwardly protruding extension 52 formed on the end wall 18 of an adjacent barrier 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

Figure 2:
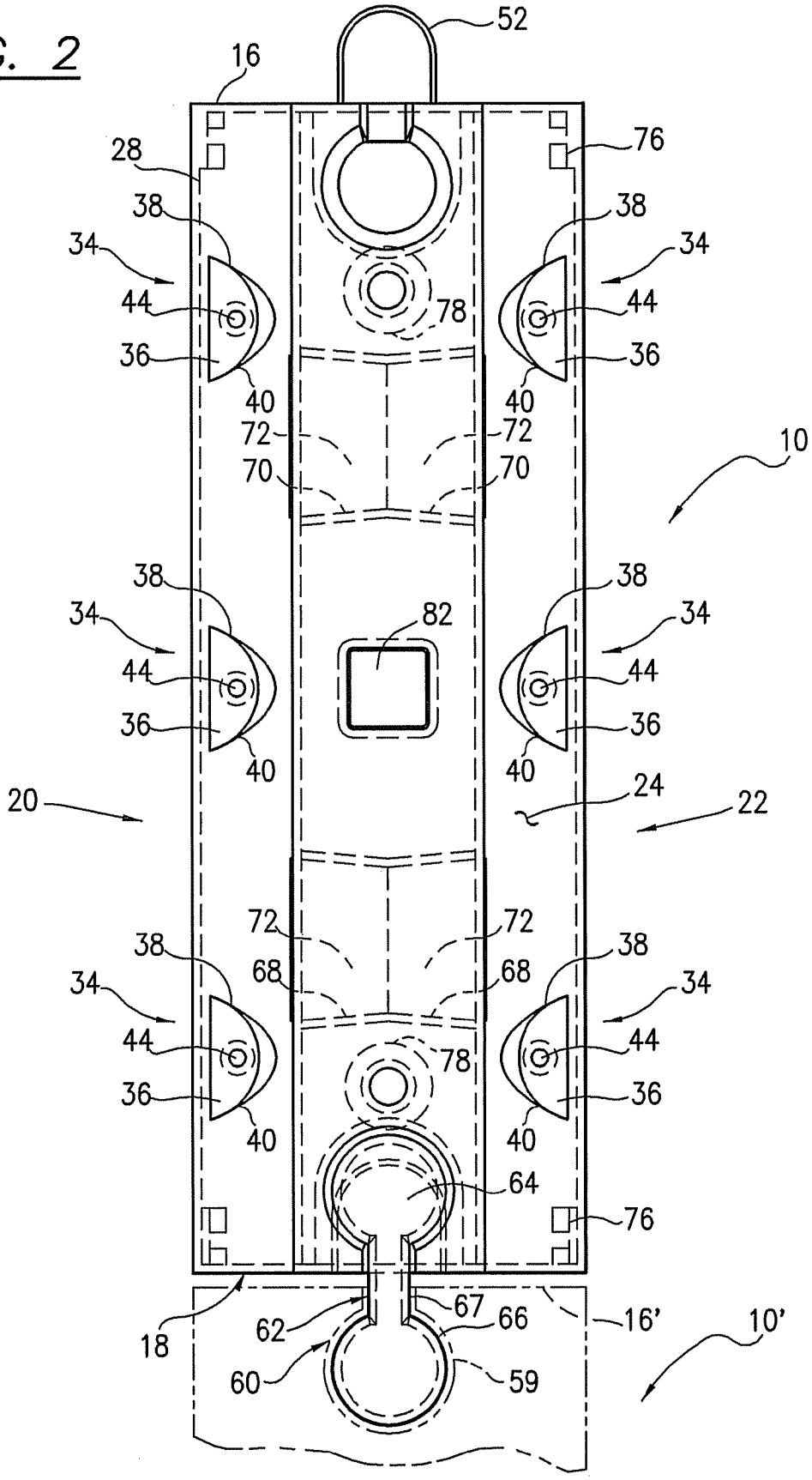
FIG. 2 is a plan view of the barrier depicted in FIG. 1, with a portion of a second barrier shown in phantom at one end.
Figure 3:
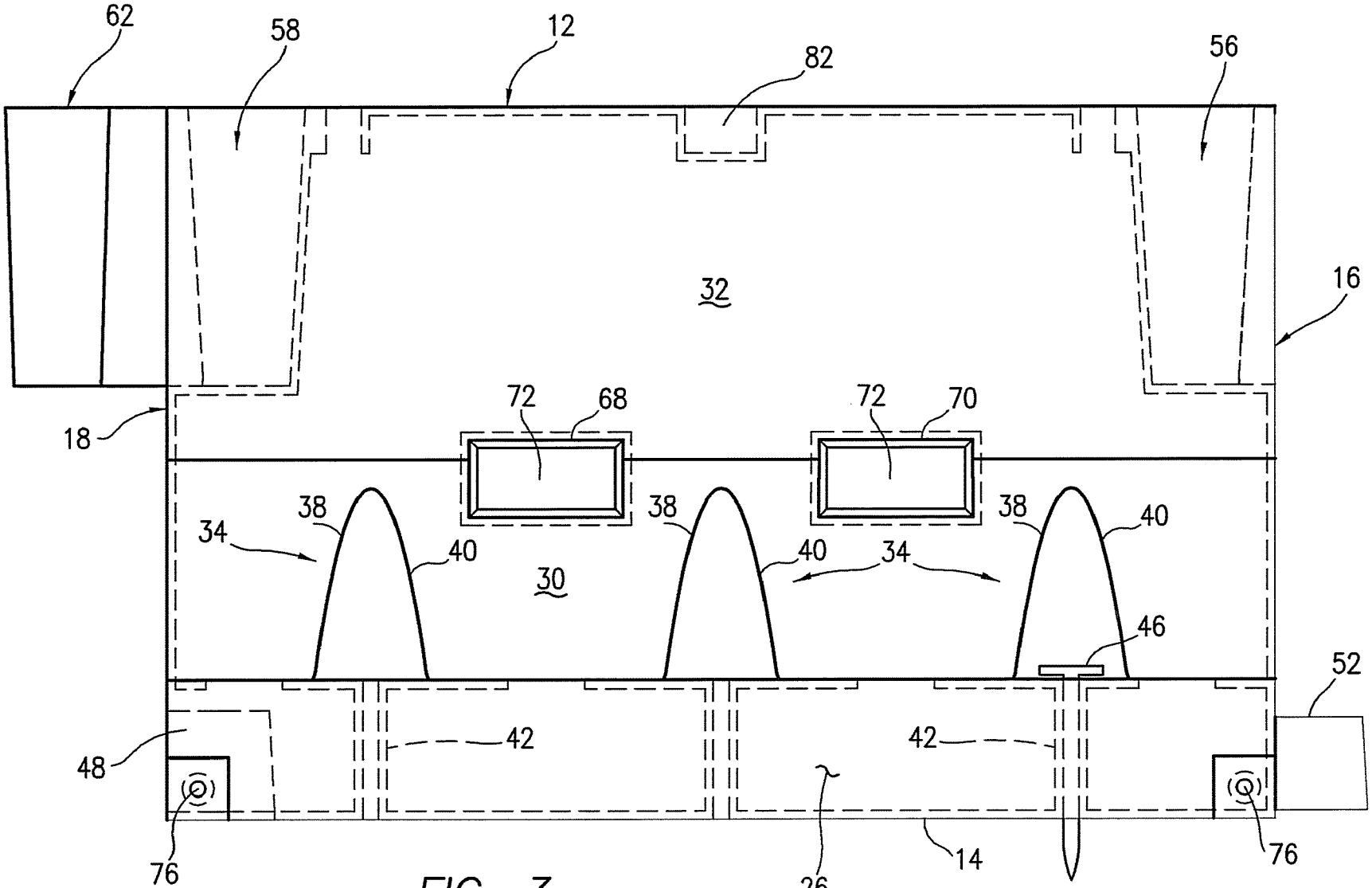
FIG. 3 is a side view of the barrier of FIG. 1.

When two barrier devices 10 and 10' are oriented end-to-end, with the end wall 16 of one barrier 10 abutting the end wall 18' of an adjacent barrier 10', the slots 56, 58 collectively form a barbell-shaped locking channel 60 shown in FIG. 4 and also depicted in phantom at the bottom of FIG. 2. This locking channel 60 receives a coupler 62 having cylindrical ends 64, 66 and a rectangular center section 67, which is removably insertable therein and extends substantially along the entire length of the locking channel 60. The cylindrical ends 64, 66 of coupler 62 pivot within the correspondingly shaped cylindrical portions 59, 59' of slots 56, 58', so that one barrier device 10 can be pivoted with respect to an adjacent barrier 10' to assist with alignment thereof, and to allow the barriers 10, 10' when placed end-to-end to follow curves along a particular highway or other location where they are placed.

Additionally, a pair of hollow channels 68 and 70 are located within the hollow interior 24 of barrier device 10 and extend between the side walls 20, 22. A portion of both channels 68, 70 is located in the intermediate section 30 of each side wall 20, 22, and extends partially into the upper sections 32 thereof. The two channels 68, 70 are positioned in the spaces between the three stabilizers 34 formed in the side walls 20, 22, and provide added internal support to the barrier 10 so that it retains its shape when filled with a ballast material. Each of the channels 68 and 70 define a pass-through hole or opening 72 adapted to receive the tines of a forklift truck to permit handling of the barriers 10.

In the presently preferred embodiment, a drain hole 76 is formed along each of the end walls 18 and 20 thereof near the bottom wall 14 to allow passage of water and the like from one side of the barrier device 10 to the other. Water or other flowable material is introduced into the hollow interior 24 of the barrier device 10 via the fill holes 33 formed in top wall 12. These fill holes 33 can also receive the post of a sign or the like (not shown) extendable into the barrier interior 24. As shown in FIG. 2, a post boot 78 is formed at the bottom wall 14 of barrier 10, in alignment with each fill hole 33, to receive and support the post of a sign inserted through the fill hole 33. Preferably, the top wall 12 is formed with an elongated channel 80 leading to each fill hole 33 to allow for the flow of rainwater into the hollow interior 24. The top wall 12 is also formed with an internally extending seat 82 which is adapted to mount an internal light fixture (not shown) for illuminating the barrier device 10 from the inside. The details of such lighting construction form no part of this invention and are thus not discussed herein.

Figure 5:
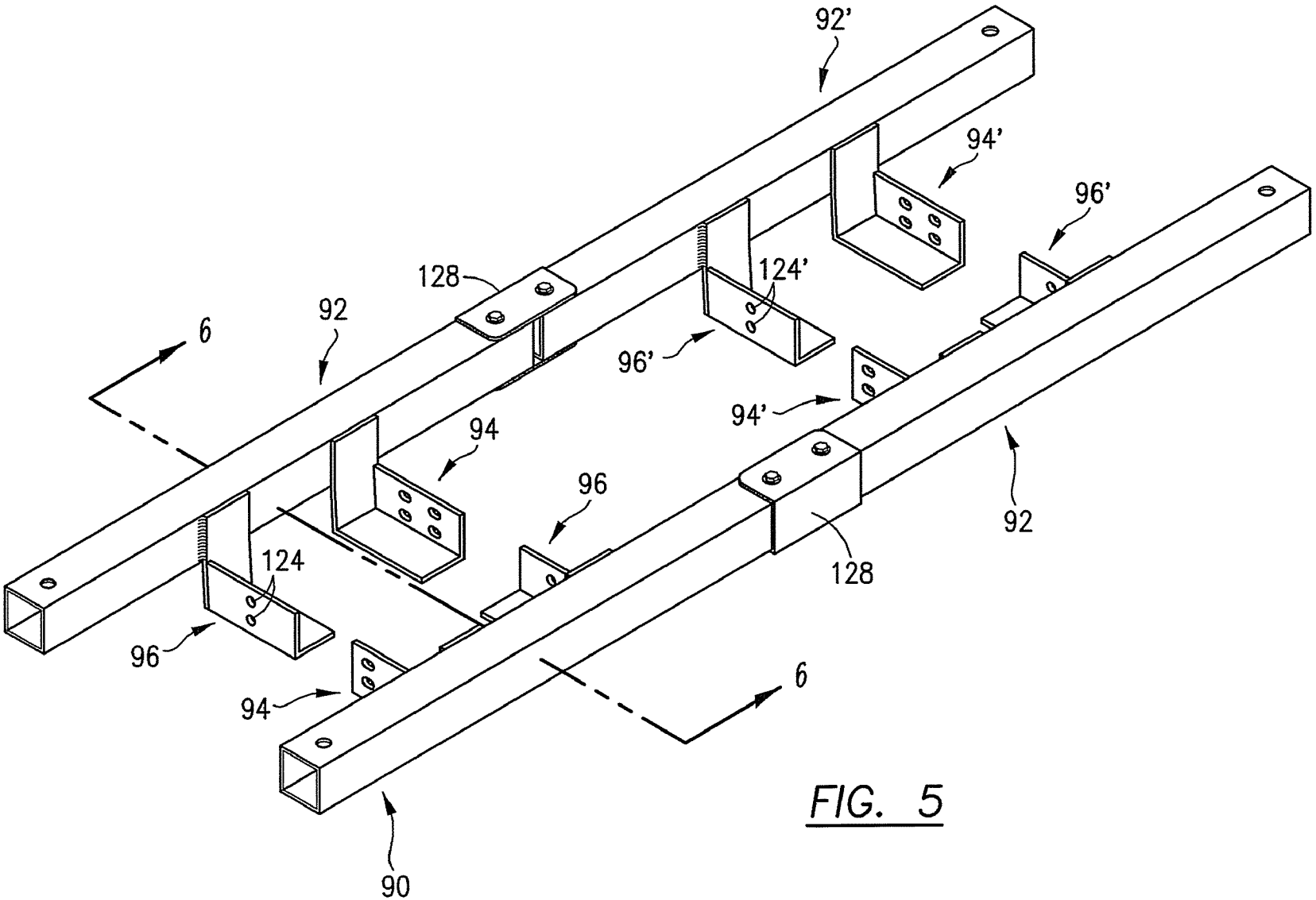
FIG. 5 is a perspective view of the adjustable external reinforcement structure herein removed from a barrier device and not yet assembled.
Figure 6:
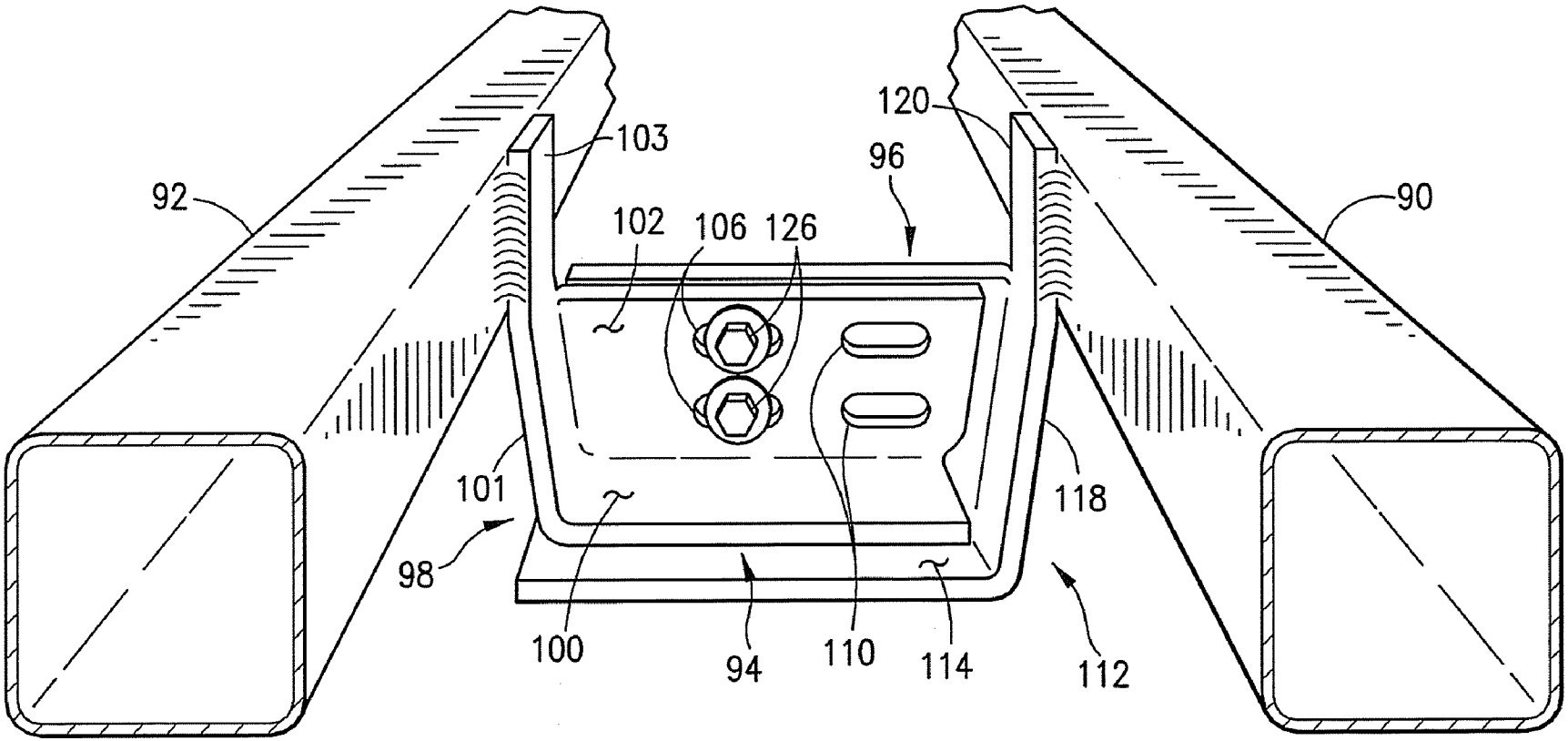
FIG. 6 is an end view of the structure shown in FIG. 5, with the locking plates of the mounting devices connected at one lateral position.
Figure 7:
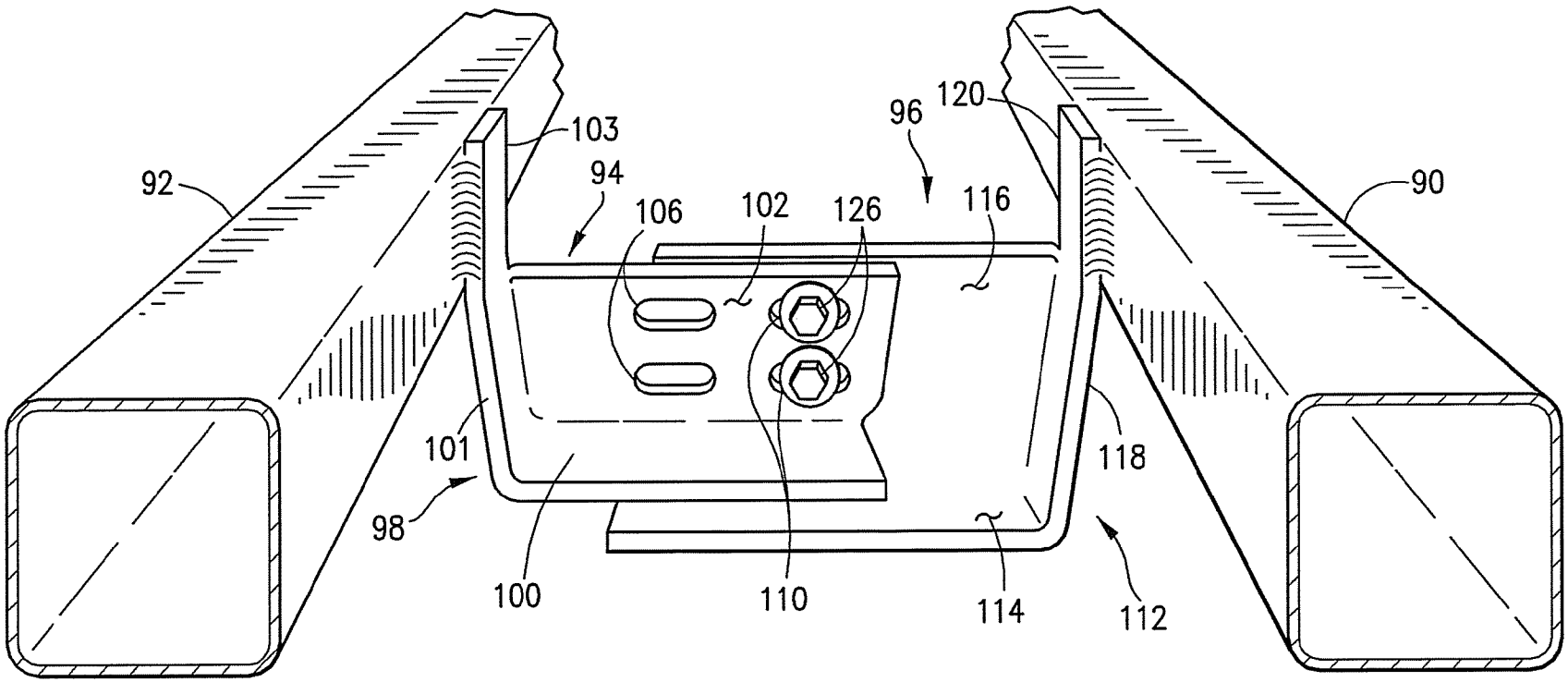
FIG. 7 is view similar to FIG. 6 except with the locking plates connected together at another lateral position.

With reference to FIGS. 5-7, a presently preferred embodiment of the external reinforcement structure of this invention is shown. Preferably, the reinforcing structure comprises a first beam 90 and a second beam 92 which are connected to one another along respective side walls 20 and 22 by a first mounting device 94 and a second mounting device 96. As shown, the beams 90, 92 are preferably hollow box beams having a generally square cross section which can be formed of metal, rubber, composite material or the like. For purposes of illustration, two sets of beams 90, 92 and 90', 92' are depicted in FIG. 5 corresponding to the two barrier devices 10 and 10' shown in FIG. 4. The structure and operation of the beams 90, 92 and 90', 92' are identical, and therefore the following discussion applies to both.

As best shown in FIGS. 4 and 5, a first mounting device 94 is connected to the beam 90 and a second mounting device 96 is connected to the beam 92 in position for insertion into the opening 68 in the barrier device 10 (or 10'), as discussed below. The position of the mounting devices 94, 96 relative to the beams 90, 92 is reversed for the second opening 70 in the barrier device 10, i.e. a first mounting device 94 is mounted to the beam 92 and a second mounting device 96 is mounted to the beam 90 in position for insertion into the opening 70.

Each of the first mounting devices 94 employed in this invention has the same construction, and comprises a side plate 98, a base plate 100 and a locking plate 102. The side plate 98 has an outwardly tapered portion 101 that transitions to a vertical section 103 which is welded or otherwise permanently connected to a beam 90 at a location in alignment with the opening 68 or to a beam 92 for alignment with the opening 70 in the barrier device 10. The base plate 100 of first mounting device 94 may be integrally formed with, welded or otherwise permanently connected to the side plate 98. It extends generally perpendicular to the side plate 98 and is oriented substantially horizontally when the first mounting device 94 is installed on the barrier device 10. The locking plate 102 is preferably permanently secured by welding or the like to both the side plate 98 and the base plate 100 in an upright, vertical position substantially perpendicular to both plates 98, 100. As such, one of the opposed end edges of the locking plate 102 abuts the side plate 98 and its bottom edge abuts the base plate 100. The locking plate 102 of first mounting device 94 is formed with one column of vertically spaced bores 106, and a second column of vertically spaced bores 110. The columns of bores 106, 110 are laterally spaced from one another, e.g. in a direction between the opposed end edges of the locking plate 102. Preferably, the bores 106 and 110 are elongated in the lateral direction as shown in the Figs.

Each of the second mounting devices 96 has generally the same construction as the first mounting devices 94. As best seen in FIG. 7, the second mounting devices each comprise a side plate 112, a base plate 114 and a locking plate 116. The side plate 112 has an outwardly tapered portion 118 that transitions to a generally vertical section 120 which is welded or otherwise permanently connected to a beam 90 at a location in alignment with the opening 68 or to a beam 92 for alignment with the opening 70 in the barrier device 10. The base plate 114 of second mounting device 96 may be integrally formed with, welded or otherwise permanently connected to the side plate 112. It extends generally perpendicular to the side plate 112 and is oriented substantially horizontally when the second mounting device 96 is installed on the barrier device 10. The locking plate 116 of the second mounting device 96 is preferably permanently secured by welding or the like to both the side plate 112 and the base plate 114 in an upright, vertical position substantially perpendicular to both plates 112, 114. The locking plate 116 of second mounting device 96 is formed with a single column of vertically spaced, circular bores 124 at approximately the center point thereof. See FIG. 5.

Installation of the beams 90, 92 and mounting devices 94, 96 proceeds as follows. The beam 90 is aligned with openings 68 and 70 in the barrier device 10 so that the base plate 100 and locking plate 102 of first mounting device 94 mounted thereto may be inserted within the opening 68. At the same time, the base plate 114 and locking plate 116 of the second mounting device 96 secured to the beam 90 extends into the opening 70 of barrier device 10. The same procedure is followed for beam 92, except, as noted above, the positioning of the mounting devices 94 and 96 along the beam 92 is reversed. Specifically, the base plate 114 and locking plate 116 of second mounting device 96 connected to the beam 92 are inserted into the opposite side of opening 68 from the beam 90, while the base plate 100 and locking plate 102 of first mounting device 94 connected to beam 92 enter the opening 70 in the barrier device 10 opposite the beam 90.

The external reinforcement structure of this invention is characterized as "adjustable" because the first and second mounting devices 94, 96 within each opening 68, 70 in the barrier device 10 can be connected to one another at different lateral locations. Referring to FIG. 6, which depicts the first and second mounting devices 94, 96 secured within the opening 70 of barrier device 10, the two bores 106 in one column 104 of locking plate 102 of a first mounting device 94 are positioned in alignment with the bores 124 in the locking plate 116 of the second mounting device 96. Bolts 126 or other fasteners may be inserted through the aligning bores 106 and 124 to releasably mount the locking plates 102 and 116 together. The locking plates 102, 116 of the first and second mounting devices 94, 96 that extend through the opening 68 in the barrier device are similarly oriented relative to one another so that their bores 106 and 124 align in the same fashion as with opening 70. In this position, the side plates 98 and 112 of the mounting devices 94, 96, and, in turn, the beams 90, 92 connected thereto are comparatively close to one another as measured in the lateral direction. It is contemplated that the mounting devices 94, 96 will be connected in this position to accommodate barrier devices 10 of smaller "width" or lateral spacing between their side walls 20, 22. For wider barrier devices 10, the locking plates 102 and 116 of the first and second mounting devices 94, 96 are positioned such that the bores 110 in the other column of the locking plates 102 align with the bores 124 in the locking plates 116. As viewed in FIG. 7, this results in a greater lateral spacing between the side plates 98 and 112, and therefore the beams 90, 92, so that the external reinforcement structure of this invention may be used with wider barrier devices 10. Bolts 126 or other fasteners may be inserted within the aligning bores 110 and 124 as described above. The external reinforcement structure of this invention therefore provides an essentially one-piece rigid structure for connection beams 90, 92 along respective side walls 20, 22 of the barrier device 10, while being adjustable to accommodate barriers 10 of different width.

In the presently preferred embodiment, either before or after the beams 90, 92 are secured along the side walls 20 and 22 of the barrier device 10, and the beams 90', 92' are mounted to the side walls 20', 22' of barrier device 10', a bracket 128 may be bolted to the adjacent ends of beams 90, 90' and 90', 92' as shown in FIGS. 4 and 5. The brackets 128 add further rigidity to the external reinforcement structure herein, and resist disengagement of one barrier device 10 from an adjacent barrier device 10'.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A barrier device, comprising:

a top wall, a bottom wall, opposed end walls and opposed side walls interconnected to collectively form a hollow interior;

at least one opening extending through said hollow interior from one of said side walls to the other of said side walls;

a barrier reinforcement structure comprising:

(i) a first beam extending along one of said side walls;

(ii) at least one first mounting device including a first locking plate coupled to said first beam;

(iii) a second beam extending along the other of said side walls;

(iv) at least one second mounting device including a second locking plate coupled to said second beam;

(v) one of said first and second locking plates being formed with a first bore, and the other of said first and second locking plates being formed with spaced second and third bores;

each of said first and second locking plates being insertable into said at least one opening in said hollow interior in position so that said first bore of said one locking plate aligns with one of said first and second bores of the other locking plate, a fastener extending through said aligning bores to connect said first and second locking plates together and to secure said first and second beams along respective side walls.

2. The barrier device of claim 1 in which each of said first and second locking plates has one end coupled to respective first and second beams and a second end, said second and third bores being spaced from one another in a direction between said first and second ends.

3. The barrier device of claim 2 in which said first and second beams are spaced a first distance from one another with said first bore of said one locking plate in alignment with said second bore of said other locking plate, and said first and second beams being spaced a second distance from one another with said first bore of said one locking plate in alignment with said third bore of said other locking plate.

4. The barrier device of claim 3 in which said first distance is greater than said second distance.

5. The barrier device of claim 1 further including first side plate connected to each of said first beam and said first locking plate of said first mounting device, and a first base plate mounted to each of said first side plate and said first locking plate of said first mounting device.

6. The barrier device of claim 1 further including a second side plate connected to each of said second beam and said second locking plate of said second mounting device, and a second base plate mounted to each of said second side plate and said second locking plate of said second mounting device.

7. The barrier device of claim 1 in which said at least one opening extending through said hollow interior comprises a first opening and a second opening spaced from one another in a direction between said first and second end walls, each of said first and second openings receiving a first mounting device and a second mounting device.

8. A barrier wall comprising:

a number of individual barrier devices connected end-to-end, each of said barrier devices comprising:

(i) a top wall, a bottom wall, opposed end walls and opposed side walls interconnected to collectively form a hollow interior;

(ii) at least one opening extending through said hollow interior from one of said side walls to the other of said side walls;

(iii) a barrier reinforcement structure comprising:

(a) a first beam extending along one of said side walls;

(b) at least one first mounting device including a first locking plate coupled to said first beam;

(c) a second beam extending along the other of said side walls;

(d) at least one mounting device including a second locking plate coupled to said second beam;

(e) one of said first and second locking plates being formed with a first bore, and the other of said first and second locking plates being formed with spaced second and third bores;

each of said first and second locking plates of said barrier devices being insertable into said at least one opening in said hollow interior thereof in position so that said first bore of said one locking plate aligns with one of said first and second bores of the other locking plate, a fastener extending through said aligning bores to connect said first and second locking plates together and to secure said first and second beams along respective side walls of said barrier device;

connecting structure located at each end of said first beam and said second beam of each barrier device, said connecting structure being effective to connect said first beam of one barrier device to a first beam of an adjacent barrier device and to connect said second beam of said one barrier device to said second beam of an adjacent barrier device.

9. The barrier wall of claim 8 in which each of said first and second locking plates of said individual barrier devices has one end coupled to respective first and second beams and a second end, said second and third bores being spaced from one another in a direction between said first and second ends.

10. The barrier wall of claim 9 in which said first and second beams of each barrier device are spaced a first distance from one another with said first bore of said one locking plate in alignment with said second bore of said other locking plate, and said first and second beams being spaced a second distance from one another with said first bore of said one locking plate in alignment with said third bore of said other locking plate.

11. The barrier wall of claim 10 in which said first distance is greater than said second distance.

12. The barrier wall of claim 8 further including first side plate connected to each of said first beam and said first locking plate of said first mounting device, and a first base plate mounted to each of said first side plate and said first locking plate of said first mounting device of said individual barrier devices.

13. The barrier wall of claim 8 further including a second side plate connected to each of said second beam and said second locking plate of said second mounting device, and a second base plate mounted to each of said second side plate and said second locking plate of said second mounting device of said individual barrier devices.

14. The barrier wall of claim 8 in which said at least one opening extending through said hollow interior of each of said barrier devices comprises a first opening and a second opening spaced from one another in a direction between said first and second end walls, each of said first and second openings receiving a first mounting device and a second mounting device.

* * * * *